United States Patent [19]

Meier

[11] Patent Number: 4,832,740

[45] Date of Patent: May 23, 1989

[54] PROCESS FOR REMOVING ALKALI AND ALKALINE EARTH ELEMENTS FROM ALUMINUM MELTS

[75] Inventor: Ernst Meier, Steg, Switzerland

[73] Assignee: Swiss Aluminium Ltd., Chippis, Switzerland

[21] Appl. No.: 167,982

[22] Filed: Mar. 14, 1988

[30] Foreign Application Priority Data

Mar. 30, 1987 [CH] Switzerland ..... 1209/87

[51] Int. Cl.[4] ..... C22B 21/00

[52] U.S. Cl. ..... 75/68 R; 75/93 AC

[58] Field of Search ..... 75/93 AC, 68 R

[56] References Cited

U.S. PATENT DOCUMENTS 3,972,709 8/1976 Chia ..... 75/93 AC 4,470,846 9/1984 Dubé ..... 75/93 AC

*Primary Examiner*—Peter D. Rosenberg

*Attorney, Agent, or Firm*—Bachman & LaPointe

[57] ABSTRACT

A process for removing alkali and alkaline earth metals from aluminum melts is such that aluminum fluoride powder is fed continuously to a carrier gas in an amount of 1–10 g/min. and the gas/powder mixture introduced continuously via lances into the melt which is maintained at a temperature between 690° and 780°C.

The process is characterized by a low consumption of aluminum fluoride per ton of melt to be treated and is particularly suitable for removing sodium and lithium from aluminum-magnesium alloy melts.

8 Claims, No Drawings

PROCESS FOR REMOVING ALKALI AND ALKALINE EARTH ELEMENTS FROM ALUMINUM MELTS

BACKGROUND OF THE INVENTION

The invention relates to a process for removing alkali and alkaline earth metals from aluminum melts by introducing aluminum fluoride powder into the melt.

Primary aluminum from the electrolytic cell often contains considerable amounts of alkali and alkaline earth metals. Before such contaminated metal can be processed further, in particular before casting into rolling slabs, it is in most cases essential that the concentration of the undesired impurity elements is reduced.

Known from the European patent publication EP-A-0 065 854 is a process for removing alkali and alkaline earth metals from aluminum melts, said process involving the addition of aluminum fluoride powder to a vortex created in the melt. The treatment takes place in a cylindrical container having a capacity for 3–5 tons of molten aluminum. This process enables small charges of aluminum to be treated effectively in a relatively short time. On the other hand, the amount of aluminum fluoride required to treat each ton of metal is very high. Furthermore, special devices are required to stir the melt.

In view of the above the object of the invention is to develop a process of the kind described at the start, by means of which the consumption of aluminum fluoride is kept as low as possible, at the same time maintaining the high efficiency of melt purification. In addition it is a further object to be able to carry out the process using already existing melt treatment equipment without very much alteration to the same.

SUMMARY OF THE INVENTION

The foregoing object is achieved by way of the present invention in which the aluminum fluoride is fed continuously to a carrier gas in an amount of 1–10 g/min and the gas/powder mixture introduced continuously via lances into the melt which is maintained at a temperature of 690°–780° C.

DETAILED DESCRIPTION

The result of introducing the aluminum fluoride into the melt in the form of a gas/powder mixture is that the aluminum fluoride is enclosed in gas bubbles in the melt and deposits itself in the lower part of the bubbles. The actual chemical reaction between the aluminum fluoride and the alkali and alkaline earth elements takes place therefore at the gas/melt interface as the gas bubble rises to the surface of the melt. It is easy to see that a relatively small amount of aluminum fluoride suffices to cover the lower part of the gas bubble surface. Furthermore it turns out that the aluminum fluoride introduced via a carrier gas is wet better by the melt than is the case in the process using direct addition of powder. This explains why a high degree of efficiency in melt purification can also be achieved with a small amount of aluminum fluoride using the process according to the invention.

The flow rate of the carrier gas is preferably between 40 and 200 liters per minute. The metallostatic pressure determines the lower limit. The amount of movement of the melt surface, and thus the formation of dross, sets the upper limit.

Instead of pure aluminum fluoride it is also possible to employ a lower purity grade of aluminum fluoride i.e. containing up to about 20% aluminum oxide. Similarly, cryolite containing excess aluminum fluoride is also suitable for this purpose.

Argon is a preferred carrier gas, if desired with an addition of a hydrocarbon with halide substitution e.g. $CCl_2F_2$. Other gases or gas mixtures, however, can also be employed, as is normal in the melt treatment of aluminum.

The aluminum fluoride can be fed to the carrier gas in a simple and effective manner via a jet mixer, largely as described in the US patent publication US-A-295 883 for introducing gases into a melt stream. The gas flow creates a negative pressure in the jet mixer, which causes the aluminum fluoride to be sucked into the jet mixer and into the gas stream.

The process according to the invention is particularly suitable for removing sodium and lithium from aluminum-magnesium alloy melts, and can be implemented in the conventional melting furnace with gas flushing without very much alteration being required. For that purpose the aluminum fluoride is fed in to the gas supply line, if necessary or desired via a jet mixer.

The advantage of the process according to the invention is demonstrated in the following with the aid of an exemplified embodiment of the invention.

A 28 ton charge of an AlMg alloy of the AlMg3 type was held in a hearth type furnace at a temperature of 740°+/−10° C. and treated by means of a gas/powder mix with aluminum fluoride for 2.5 h. A gas mixture of 93% argon and 7% $CCl_2F_2$ was fed to the melt at a rate of 150 liters per minutes via six graphite lances supplied from a main gas supply line. The aluminum fluoride powder was added via a jet mixer built into the said main gas supply line. The aluminum fluoride stored in a container above the jet mixer was fed to the jet mixer via a connecting pipe, as a trickling stream flowing at a rate of 3.5 g/min. A length of perpendicular pipe, inserted in the connecting pipe and having an appropriate inner diameter for the purpose, served as the feeding device.

Before the treatment the sodium content of the melt was 29 ppm, after the treatment 2 ppm. During the treatment time of 2.5 h therefore only 525 g of aluminum fluoride had been consumed, corresponding to 18 g per ton of heated melt.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for removing alkali and alkaline earth metals from aluminum melts comprising: providing an aluminum melt; maintaining said aluminum melt at a temperature of about between 690° to 780° C.; and feeding aluminum fluoride in the presence of a carrier gas to said aluminum melt wherein the carrier gas flow rate is about between 40 to 200 liters per minute and said aluminum fluoride is fed in an amount of about between 1 to 10 grams per minute of aluminum fluoride whereby alkali and alkaline earth metals are removed from said melt.

2. A process according to claim 1 wherein said aluminum fluoride is derived from cryolite.

3. A process according to claim 1 wherein lances are provided for introducing said aluminum fluoride and carrier gas.

4. A process according to claim 1 wherein the carrier gas is argon.

5. A process according to claim 4 wherein said carrier gas contains an addition of a hydrocarbon with halide substitution.

6. A process according to claim 1 wherein the aluminum fluoride is fed to the carrier gas via a jet mixer.

7. A process according to claim 1 wherein the aluminum melt is an aluminum-magnesium alloy melt.

8. A process according to claim 1 wherein said aluminum fluoride is mixed with said carrier gas prior to introduction to said aluminum melt.

* * * * *